US008978609B2

(12) United States Patent
Dogan et al.

(10) Patent No.: US 8,978,609 B2
(45) Date of Patent: Mar. 17, 2015

(54) OSCILLATING MOTOR ADJUSTER

(71) Applicant: Hilite Germany GmbH, Marktheidenfeld (DE)

(72) Inventors: Fatih Dogan, Nurtingen (DE); Andreas Knecht, Kusterdingen (DE)

(73) Assignee: Hilite Germany GmbH (DE)

( * ) Notice: Subject to any disclaimer, the term of this patent is extended or adjusted under 35 U.S.C. 154(b) by 0 days.

(21) Appl. No.: 14/102,266

(22) Filed: Dec. 10, 2013

(65) Prior Publication Data

US 2014/0158075 A1 Jun. 12, 2014

(30) Foreign Application Priority Data

Dec. 11, 2012 (DE) ..... 10 2012 112 059

(51) Int. Cl.
*F01L 1/34* (2006.01)
*F01L 1/344* (2006.01)

(52) U.S. Cl.
CPC ..... *F01L 1/3442* (2013.01); *F01L 2001/34426* (2013.01); *F01L 2001/34433* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 7,025,023 | B2 * | 4/2006 | Lehmann et al. | 123/90.17 |
| 8,261,706 | B2 | 9/2012 | Weiss et al. | |
| 8,534,246 | B2 * | 9/2013 | Lichti et al. | 123/90.17 |

FOREIGN PATENT DOCUMENTS

| | | |
|---|---|---|
| DE | 10 2007 040 017 | 2/2009 |
| DE | 10 2009 035 233 | 3/2011 |

* cited by examiner

*Primary Examiner* — Ching Chang
(74) *Attorney, Agent, or Firm* — Clark Hill PLC

(57) ABSTRACT

The invention relates to an oscillating motor adjuster with a stator (1), a rotor (8) which is positioned within the stator (1) and is displaceable relative to the stator (1) on a first rotor connection (11) by hydraulic pressure in a first direction, and relative to the stator (1) on a second rotor connection (13) by hydraulic pressure in a second direction, a central valve (12) which projects through a hub (7) of the rotor (8) and is inserted into a camshaft (18), wherein the central valve (12) has a first working connection (A) and, at an axial distance from the first working connection (A), a second working connection (B), and wherein the first working connection (A) is connected to the first rotor connection (11) and the second working connection (B) to the second rotor connection (13). According to the invention, provision is made for an annular chamber between the central valve (12) and the rotor (8) to be divided by a sleeve (30) into two annular chambers (19, 20), wherein one of the two annular chambers (19) connects the first working connection (A) to the first rotor connection (11) and the other annular chamber (20) connects the second working connection (B) to the second rotor connection (13).

16 Claims, 2 Drawing Sheets

OSCILLATING MOTOR ADJUSTER

RELATED/PRIORITY APPLICATION

Figure 1:
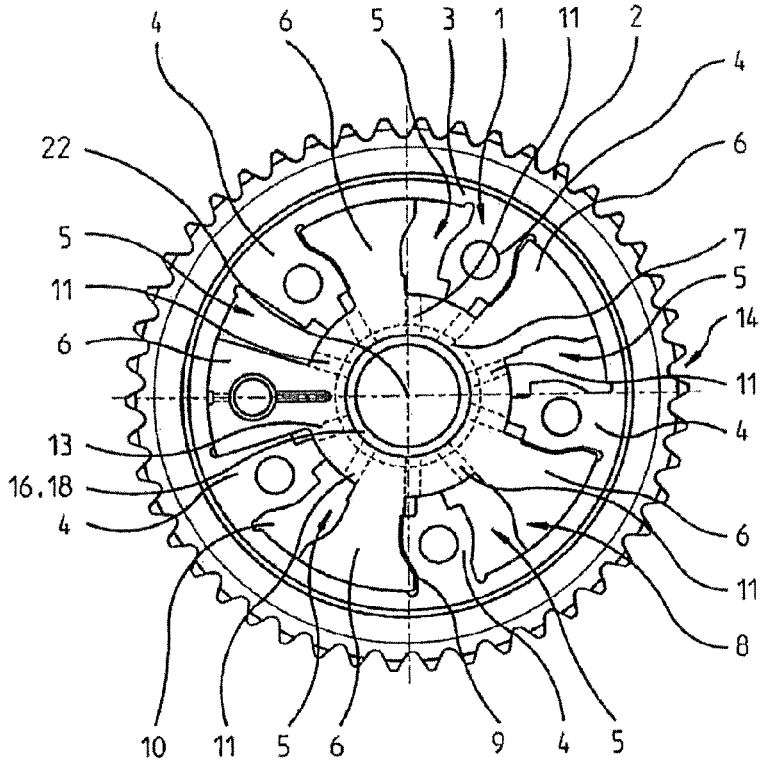

This application relies upon German Application No, 10 2012 112 059.5, filed on Dec. 11, 2012, for priority.

The invention relates to an oscillating motor adjuster having the features mentioned in the claims.

An oscillating motor adjuster is used during operation of a combustion engine to steplessly change the angular position of the camshaft relative to a drive wheel. By twisting of the camshaft, the opening and closure times of the gas-exchange valves are offset sin such a way that the combustion engine performs optimally for the respective rotation speed. Oscillating motor adjusters have a stator 1, which is non-rotatably connected to the drive wheel. Within the stator, a rotor is arranged which is non-rotatably connected to the camshaft and can be displaced relative to the stator by hydraulic pressure on one of its two rotor connections. The hydraulic pressure is supplied by a central valve inserted in the camshaft, at the first or second working connection of said valve.

The aim of the present invention is to demonstrate a way of connecting the working connections of the central valve cost-effectively each with one of the two rotor connections.

This aim is achieved with an oscillating motor adjuster having the features mentioned in the independent claim. Advantageous further developments of the invention are the subject of subordinate claims.

In an oscillating motor adjuster according to the invention, the working connections of the central valve are connected to the rotor connections via an annular chamber. To this end, an annular chamber between central valve and rotor is divided by a sleeve into two annular chambers, each of which connects one of the two working connections to one of the rotor connections. The two annular chambers are each sealed on the one hand from the central valve and on the other from the rotor. Hydraulic pressure on a working connection of the central valve is thus transmitted to the associated rotor connection, with the result that the angular position of the rotor can be controlled relative to the stator.

The two areas of sealing on the sleeve, that is, to the central valve and to the rotor, can be sealed with sealing rings. Preferably only one of the two areas of sealing is sealed with a sealing ring, while the other area of sealing is sealed by press fitting of the sleeve. For example, a sealing ring may be positioned between the sleeve and the central valve and the sleeve be pressed into the hub of the rotor. In this way, especially cost-effective manufacture is possible, since the sleeve is manufactured at low cost, for example by deep-drawing from sheet metal, and need only be centred relative to the rotor. Manufacturing and positioning tolerances of the sleeve relative to the central valve enclosed by the sleeve may be compensated with a sealing ring, for example, an O-ring.

An advantageous further development of the invention provides for the sleeve to project from the rotor. For example, a portion of the sleeve projecting from the rotor may have an annular shoulder in which there is a recess into which a projection of the rotor engages. In this way, positioning of the sleeve relative to the rotor is made easier, and twisting of the sleeve relative to the rotor is prevented.

The sleeve may be manufactured as, for example, a doubly-drawn deep-drawn part. The sleeve preferably has three cylindrical portions, for example, a first cylindrical portion which presses a sealing ring against the central valve, a second cylindrical portion which is in contact with the rotor, and a third cylindrical portion, outside the rotor. In this arrangement, the diameter of the second cylindrical portion is preferably larger than the diameter of the first cylindrical portion and the diameter of the third cylindrical portion is larger than the diameter of the second cylindrical portion.

Further details and advantages of the invention are illustrated in the embodiment, with reference to the attached drawings.

The drawings are as follows:

FIG. 1 A cross-sectional view of an oscillating motor adjuster, and

Figure 2:
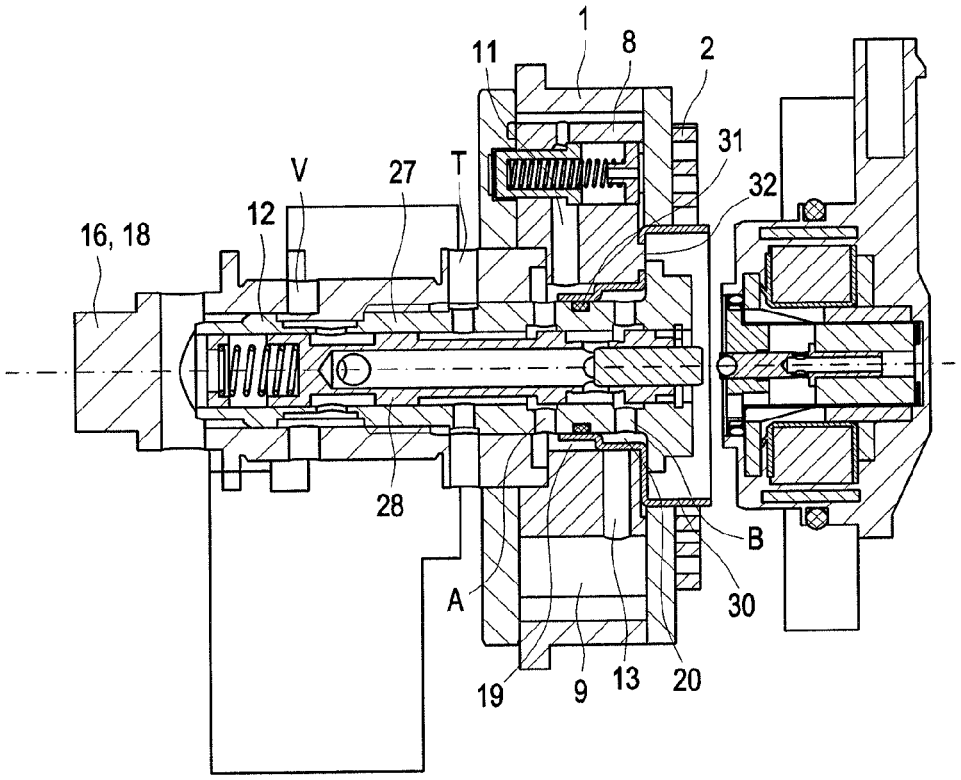

FIG. 2 The oscillating motor adjuster in longitudinal section.

With an oscillating motor adjuster 14 according to FIGS. 1 and 2, during operation of a combustion engine the angular position of the camshaft 18 is steplessly changed relative to a drive wheel 2. By twisting of the camshaft 18, the opening and closure times of the gas-exchange valves are offset in such a way that the combustion engine performs optimally for the respective rotation speed. The oscillating motor adjuster 14 has a cylindrical stator 1 which is non-rotatably connected to the drive wheel 2. In the example embodiment, the working wheel 2 is a chain wheel, over which a chain—not shown in greater detail—is guided. However, the drive wheel 2 may also be a toothed belt wheel over which a drive belt is guided as the drive element. Via this drive element and the drive wheel 2, the stator 1 is drivably connected to the crankshaft.

The stator 1 comprises a cylindrical stator base body 3, on the inside of which base body crosspieces 4 project radially inwards at equal distances. Between adjacent crosspieces 4, intermediate chambers 5 are formed, into which pressure medium 5 is introduced, controlled by a central valve 12 shown in detail in FIG. 2. Vanes 6, jutting radially outwards from a cylindrical rotor hub 7 of a rotor 8, rise up between adjacent crosspieces 4. These vanes 6 divide the intermediate chambers 5 between the crosspieces 4 in each case into two pressure chambers 9 and 10. The one pressure chamber 9 is associated with adjustment in the "early" direction, whereas the other pressure chamber is associated with adjustment in the "late" direction.

The crosspieces 4 are positioned on the outer casing surface of the rotor hub 7 with their front faces forming a seal. The vanes 6, for their part, are positioned on the cylindrical internal wall of the stator base body 3 with their front faces forming a seal.

The rotor 8 is non-rotatably connected to the camshaft 18. To change the angular position between the camshaft 18 and the drive wheel 2, the rotor 8 is turned relative to the stator 1. To this end, the pressure medium in the pressure chambers 9 or 10 is pressurised, depending on the desired direction of rotation, while the respectively other pressure chambers 9 or 10 are discharged into the tank via the tank connector T. To swivel the rotor 8 anticlockwise relative to the stator 1 into the position shown, a first annular chamber 19 is pressurised by the central valve 12 as an annular rotor channel in the rotor hub 7. From this first rotor channel, further channels 11 then lead into the pressure chambers 10 as a first rotor connection. The first annular chamber 19 is associated with the first working connection A of the central valve 12. By contrast, to swivel the rotor 8 in the clockwise direction, a second annular chamber 20 is pressurised by the central valve 12 as an annular rotor channel in the rotor hub 7, into which annular rotor channel as a second rotor connection channels 13 have their opening. This second rotor channel 20 is associated with the second working connection B. These two annular chambers 19, 20 are arranged axially distanced from one another with respect to a central axis 22, so that they are positioned concealed one behind the other in the plane of the drawing in FIG. 1.

The oscillating motor adjuster 14 is positioned on the camshaft, which is designed as a hollow shaft 16. In addition, the rotor 8 is inserted on to the camshaft 18. The hollow shaft 16 has boreholes for a tank connection T and a power supply connection V. Depending on the position of a hollow piston 28 arranged within the bushing 27, one of the two working connections, A, B is connected either with the tank connection T or with the power supply connection, and therefore either the first rotor connection 11 or the second rotor connection 13 is impinged upon with hydraulic pressure. The rotor 8 is therefore displaced relative to the stator 1 on the first rotor connection 11 by hydraulic pressure in a first direction, and relative to the stator 1 on the second rotor connection 13 by hydraulic pressure in a second, opposite direction of rotation.

The two annular chambers 19, 20 are separated from one another in the axial direction by a sleeve 30. The annular chambers 19, 20 are thus formed by division of an annular chamber between rotor 8 and central valve 12. One of the two annular chambers 19 connects the first working connection A to the first rotor connection 11, and the other annular chamber 20 connects the second working connections B with the second rotor connection 13.

As FIG. 2 shows, the diameter of the sleeve 30 increases between the two working connections A, B of the hydraulic central valve 12. A sealing ring 31 is arranged between a first cylindrical portion of the sleeve 30 and the central valve 12. The sealing ring 31 is arranged between the two working connections A, B and can sit in a groove of the central valve 12. A second cylindrical portion of the sleeve 30, which has a larger diameter than the first cylindrical portion, forms a seal on the rotor 8 with a press fit. The second cylindrical portion has openings for the passage of hydraulic fluid, in order to connect the working connection B to the second rotor connection 13 via the annular chamber 20.

The sleeve 30 may project from the rotor 8, for example with a third cylindrical portion, which has a larger diameter than the first and second cylindrical portion. Between the second cylindrical portion and the third cylindrical portion, the sleeve 30 has an annular shoulder. The annular shoulder has a recess into which a projection 32 engages in the axial direction. The sleeve 30 is therefore non-rotatably connected to the rotor 8.

The embodiments described are given purely by way of example. A combination of the described features for different embodiments is also possible. Other features of the parts of the device belonging to the invention—in particular features which are not described—may be found in the geometries of the device parts shown in the drawings.

The invention claimed is:

1. An oscillating motor adjuster with a stator, a rotor which is positioned within the stator and is displaceable relative to the stator on a first rotor connection by hydraulic pressure in a first direction, and relative to the stator on a second rotor connection by hydraulic pressure in a second direction, a central valve which projects through a hub of the rotor and is inserted into a camshaft, wherein the central valve has a first working connection and, at an axial distance from the first working connection, a second working connection, wherein the first working connection is connected to the first rotor connection and the second working connection to the second rotor connection, wherein disposed between the central valve and the rotor is an annular chamber, wherein a sleeve is disposed in the annular chamber and divides the annular chamber into a first annular chamber and a second annular chamber, wherein the first annular chamber provides a passageway from the first working connection to the first rotor connection, and the second annular chamber provides a passageway from the second working connection to the second rotor connection;

wherein a portion of a radially exterior surface of the sleeve defines the first annular chamber between the rotor and the sleeve, and a portion of a radially interior surface of the sleeve defines the second annular chamber between the central valve and the sleeve.

2. An oscillating motor adjuster according to claim 1, characterised in that the diameter of the sleeve increases between the two working connections.

3. An oscillating motor adjuster according to claim 2, characterised in that a sealing ring is arranged between the sleeve and the central valve.

4. An oscillating motor adjuster according to claim 3, characterised in that the sealing ring is positioned on a groove of the central valve.

5. An oscillating motor adjuster according to claim 1 or claim 2, characterised in that a sealing ring is arranged between the sleeve and the central valve.

6. An oscillating motor adjuster according to claim 5, characterised in that the sealing ring is positioned on a groove of the central valve.

7. An oscillating motor adjuster according to claim 1 or claim 2, characterised in that the sleeve is positioned in contact with the rotor with a press fit.

8. An oscillating motor adjuster according to claim 7, characterised in that a portion of the sleeve in contact with the rotor has openings for the passage of hydraulic fluid.

9. An oscillating motor adjuster according to claim 1, characterised in that the sleeve projects from the rotor.

10. An oscillating motor adjuster according to claim 9, characterised in that the sleeve has a shoulder in which there is a recess into which a projection of the rotor engages.

11. An oscillating motor adjuster according to claim 10, characterised in that the sleeve has, outside the rotor, an end portion having a diameter larger than the hub of the rotor.

12. An oscillating motor adjuster according to claim 9, characterised in that the sleeve has, outside the rotor, an end portion having a diameter larger than the hub of the rotor.

13. An oscillating motor adjuster according to claim 1 or claim 2, characterised in that the sleeve has a first cylindrical portion arranged within the hub of the rotor, a second cylindrical portion which has a diameter larger than the first cylindrical portion and is arranged within the hub of the rotor, and a third cylindrical portion which has a diameter larger than the second cylindrical portion and is arranged outside the rotor.

14. An oscillating motor adjuster according to claim 1, wherein a portion of the first annular chamber is disposed between the rotor and a first portion of the sleeve, wherein the first portion of the sleeve is disposed between the central valve and the first annular chamber, and a portion of the second annular chamber is disposed between the central valve and a second portion of the sleeve, wherein the second portion of the sleeve is disposed between the rotor and the second annular chamber.

15. An oscillating motor adjuster according to claim 1, wherein the first annular chamber is on one side of the sleeve, and the second annular chamber is on an opposite side of the sleeve.

16. An oscillating motor adjuster according to claim 1, wherein the sleeve ends at the first annular chamber.

* * * * *